US005871392A

United States Patent [19]

Meikle et al.

[11] Patent Number: 5,871,392

[45] Date of Patent: Feb. 16, 1999

[54] UNDER-PAD FOR CHEMICAL-MECHANICAL PLANARIZATION OF SEMICONDUCTOR WAFERS

[75] Inventors: Scott Meikle, Boise, Id.; Laurence D. Schultz, Orlando, Fla.

[73] Assignee: Micron Technology, Inc., Boise, Id.

[21] Appl. No.: 662,483

[22] Filed: Jun. 13, 1996

[51] Int. Cl.[6] ..... B24B 1/00

[52] U.S. Cl. ..... 451/56; 156/345; 51/293

[58] Field of Search ..... 451/56, 21; 437/8, 437/228; 156/345; 51/293

[56] References Cited

U.S. PATENT DOCUMENTS

| | | | |
|---|---|---|---|
| 3,449,870 | 6/1969 | Jensen | 51/216 |
| 5,193,316 | 3/1993 | Olmstead | 51/281 SF |
| 5,216,843 | 6/1993 | Breivogel et al. | 51/131.1 |
| 5,232,875 | 8/1993 | Tuttle et al. | 437/225 |
| 5,417,726 | 5/1995 | Stout et al. | 51/293 |

*Primary Examiner*—Laurie Scheiner
*Attorney, Agent, or Firm*—Seed and Berry LLP

[57] ABSTRACT

The present invention is an under-pad placed between a polishing pad and a platen of a planarizing machine used in chemical-mechanical planarization of semiconductor wafers. The under-pad has a body and a plurality of thermal conductors positioned in the body to conduct heat through the body. The body has a top face upon which the polishing pad is positionable and a bottom face engageable with the platen. In operation, heat from the platen and polishing pad flows through the thermal conductors to reduce temperature gradients across the planarizing surface of the polishing pad.

27 Claims, 3 Drawing Sheets

UNDER-PAD FOR CHEMICAL-MECHANICAL PLANARIZATION OF SEMICONDUCTOR WAFERS

TECHNICAL FIELD

The present invention relates to an under-pad used in chemical-mechanical planarization of semiconductor wafers, and, more particularly, to an under-pad that provides effective heat transfer between a polishing pad and a platen of a planarizing machine.

BACKGROUND OF THE INVENTION

Chemical-mechanical planarization ("CMP") processes remove materials from the surface layer of a wafer in the production of ultra-high density integrated circuits. In a typical CMP process, a wafer is exposed to an abrasive medium under controlled chemical, pressure, velocity, and temperature conditions. The abrasive medium has abrasive particles that abrade the surface of the wafer, and chemicals that oxidize and/or etch the surface of the wafer. Thus, when relative motion is imparted between the wafer and the abrasive medium, material is removed from the surface of the wafer.

FIG. 1 schematically illustrates a conventional CMP machine 10 with a platen 20, a wafer carrier 30, a polishing pad 40, and a slurry 44 on the polishing pad. The platen 20 has a surface 22 to which an under-pad 25 is attached, and the polishing pad 40 is positioned on the under-pad 25. The primary function of the under-pad 25 is to provide a compressible, resilient medium to equalize the pressure between the wafer 12 and the polishing pad 40 across the face of the wafer 12. The under-pad 25 also protects the platen 20 from caustic chemicals in the slurry 44 and from abrasive particles in both the polishing pad 40 and the slurry 44. A drive assembly 26 rotates the platen 20 as indicated by arrow "A" and/or reciprocates the platen back and forth as indicated by arrow "B". The motion of the platen 20 is imparted to the pad 40 because the polishing pad 40 frictionally engages the under-pad 25. The wafer carrier 30 has a lower surface 32 to which a wafer 12 may be attached, or the wafer 12 may be attached to a resilient pad 34 positioned between the wafer 12 and the lower surface 32. The wafer carrier 30 may be a weighted, free-floating wafer carrier, or an actuator assembly 36 may be attached to the wafer carrier 30 to impart axial and rotational motion, as indicated by arrows "C" and "D", respectively.

In the operation of the conventional planarizer 10, the wafer 12 is positioned face-downward against the polishing pad 40, and then the platen 20 and the wafer carrier 30 move relative to one another. As the face of the wafer 12 moves across the planarizing surface 42 of the polishing pad 40, the polishing pad 40 and the slurry 44 remove material from the wafer 12.

CMP processes must consistently and accurately produce a uniform, planar surface on the wafer because it is important to accurately focus circuit patterns on the wafer. As the density of integrated circuits increases, current lithographic techniques must accurately focus the critical dimensions of photo-patterns to within a tolerance of approximately 0.10–0.5 $\mu$m. Focusing the photo-patterns to such small tolerances, however, is very difficult when the distance between the emission source and the surface of the wafer varies because the surface of the wafer is not uniformly planar. In fact, when the surface of the wafer is not uniformly planar, several devices on the wafer may be defective. Thus, CMP processes must create a highly uniform, planar surface.

The surface of the wafer, however, may not be uniformly planar because the rate at which the thickness of the wafer decreases as it is being planarized (the "polishing rate") often varies from one area on the wafer to another. The polishing rate is a function of several factors, one of which is the temperature at the interface between the polishing pad 40 and the wafer 12. The temperature at the pad-wafer interface typically varies from one area on the pad to another for several reasons, some of which are as follows: (1) the surface contact rate between the polishing pad and the wafer generally varies positionally from one area of the polishing pad to another; (2) high points on the planarizing surface of the polishing pad have a higher temperature than other areas on the pad because the wafer contacts such high points with more pressure; (3) the abrasiveness of the pad may vary from one area on the pad to another; and (4) the cooling/heating rate of the pad varies from one area of the pad to another. Although the above-listed factors can be adjusted, altering these parameters to control the pad-wafer interface temperature may adversely impact the polishing rate or uniformity of the finished surface of the wafer.

One desirable solution to control the pad-wafer interface temperature is to adjust the temperature of the platen to heat or cool the polishing pad as needed. Controlling the polishing pad temperature with the platen, however, is difficult because the under-pad substantially prevents heat transfer between the platen and the pad. To date, heat transfer properties have been a low priority for under-pads; instead, the properties of compressibility and resiliency have influenced the development of under-pads. Under-pads must be sufficiently compressible to compensate for wafer bow and thickness variations, and they must be sufficiently resilient to resist wear. Conventional under-pads are accordingly made from a compressible matrix material and reinforcement fibers of glass, nylon or other non-conductive materials. Although the glass or non-metal fibers control the resiliency and compressibility of under-pads, they are thermal insulators that prevent heat transfer between the polishing pad and the platen. Thus, conventional under-pads make it difficult to use the platen to control the regional temperature variances across the surface of the polishing pad.

In light of the problems with conventional under-pads, it would be desirable to develop a thermally conductive under-pad that has appropriate compressibility and resiliency characteristics.

SUMMARY OF THE INVENTION

The inventive under-pad is placed between a polishing pad and a platen of a planarizing machine used in chemical-mechanical planarization of semiconductor wafers. The under-pad has a body and a plurality of thermal conductors positioned in the body to conduct heat through the body. The body has a top face upon which the polishing pad is positionable and a bottom face engageable with the platen. In operation, heat from the platen and the polishing pad flows through the thermal conductors to reduce temperature gradients across the polishing pad.

DETAILED DESCRIPTION OF THE INVENTION

The present invention is a thermally conductive under-pad that transfers heat between a polishing pad and a platen to provide better control of the polishing pad temperature. The under-pad of the present invention is also sufficiently resilient to resist wear, and it is sufficiently compressible to equalize the pressure between the polishing pad and the wafer while producing sufficient planar features on a wafer. An important aspect of the present invention is that thermal conductors are positioned in the body of the pad. Another important aspect of the present invention is that the thermal conductors are preferably oriented substantially perpendicular to the top and bottom faces of the under-pad to form substantially direct conductive columns between the polishing pad and the platen. By providing enhanced heat transfer between the polishing pad and the platen, hot spots on the polishing pad dissipate through the under-pad. Conversely, cool spots on the polishing pad draw heat from the platen through the under-pad. The thermally conductive under-pad of the present invention, therefore, enhances the uniformity of the temperature across the polishing pad.

Figure 1:
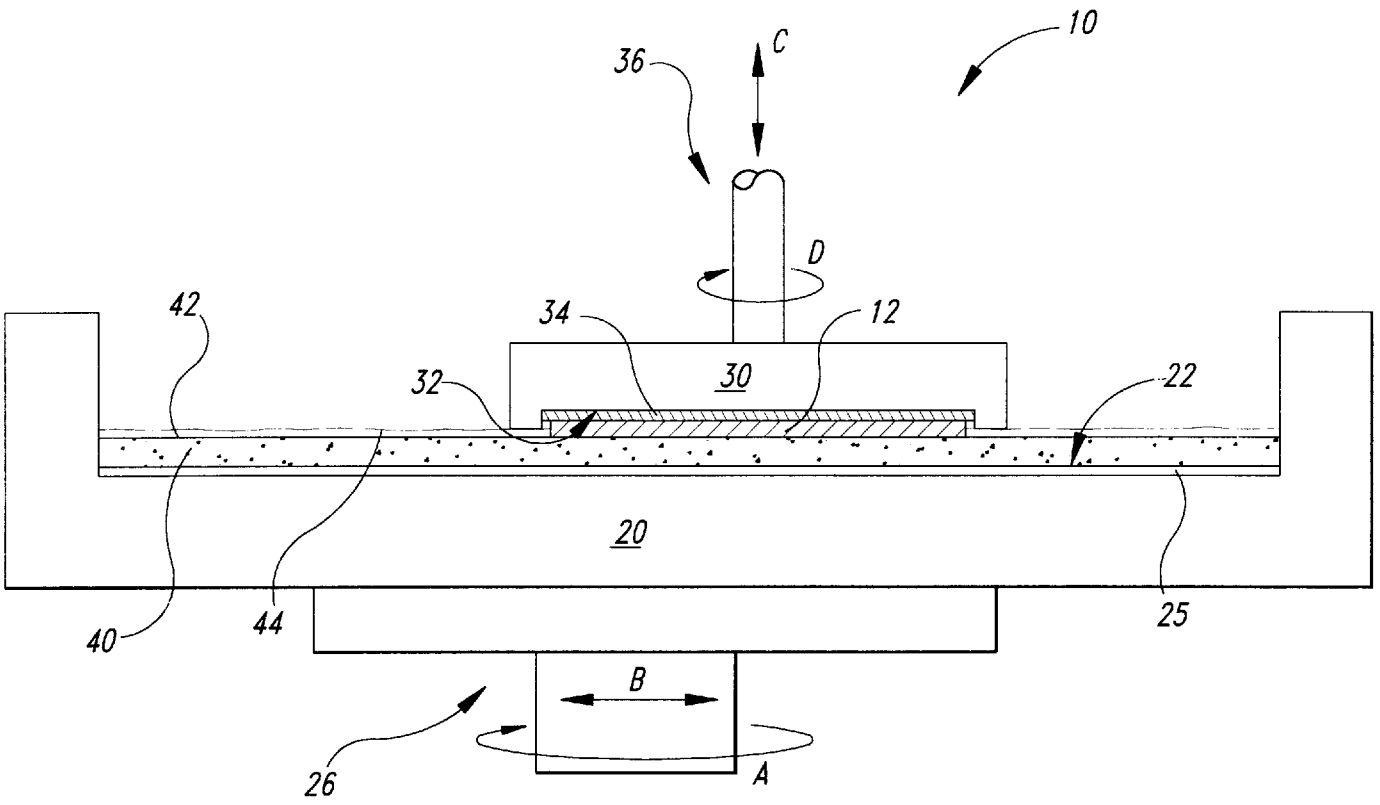
Fig. 1 (Prior Art)
FIG. 1 is a schematic cross-sectional view of a conventional planarizing machine in accordance with the prior art.
Figure 2:
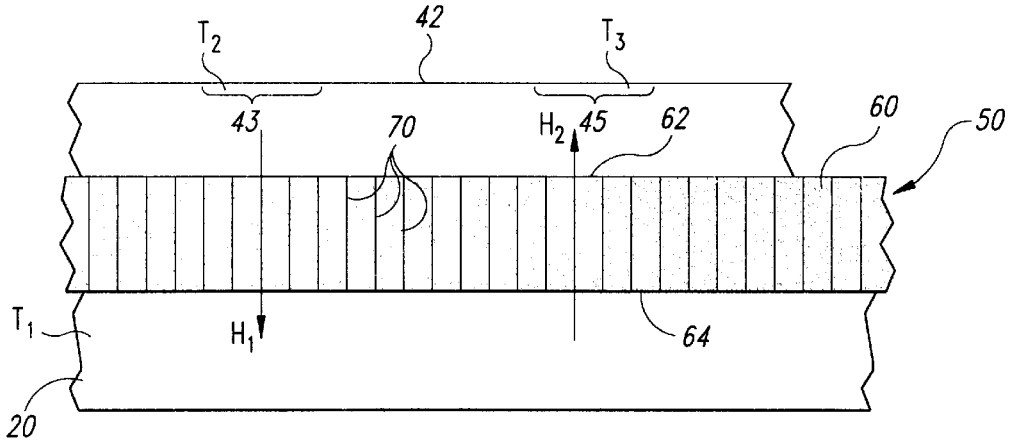
FIG. 2 is a partial schematic cross-sectional view of an under-pad in accordance with the invention.

FIG. 2 illustrates an under-pad 50 in accordance with the invention positioned between a conventional polishing pad 40 and platen 20, as discussed above with respect to FIG. 1. The under-pad 50 has a body 60 with a top face 62 and a bottom face 64. The body 60 is preferably made from a continuous phase matrix material such as polyurethane, Teflon®, or other known suitable matrix materials. A thermally conductive material, which is preferably a number of thermal conductors 70, is positioned or mixed in the body 60. The thermal conductors 70 are made from a material that has a thermal conductivity of at least 0.5 W/m°K, and preferably greater than 0.8 W/m°K. Thermal conductors made from carbon fiber are especially well suited to enhance the thermal conductivity while providing adequate resiliency and sufficient compressibility to the under-pad 50. Thus, carbon fiber thermal conductors are both thermal conductors and reinforcement elements. The thermal conductors 70 are preferably strands that extend from approximately the top face 62 to the bottom face 64. Additionally, the strands 70 are preferably positioned substantially perpendicular to the top and bottom faces 62 and 64 to form direct thermal conduction paths between the platen 20 and the polishing pad 40.

In operation, the under-pad 50 is positioned between the polishing pad 40 and the platen 20. The temperature at the pad-wafer interface typically varies across the planarizing surface 42 such that the temperature $T_2$ at one area 43 on the pad 40 is generally different than the temperature $T_3$ at another area 45 on the pad 40. For purposes of illustration, $T_2$ at area 43 is higher than a desired pad temperature and $T_3$ at area 45 is lower than a desired pad temperature. Accordingly, the temperature $T_1$ of the platen 20 is preferably less than $T_2$ so that excess heat at area 43 flows through the thermal conductors 70 in the under-pad 50 to the platen 20, as indicated by arrow $H_1$. Similarly, the temperature $T_1$ of the platen 20 is preferably greater than $T_3$ so that heat flows through the thermal conductors 70 to the polishing pad below area 45, as indicated by $H_2$. The under-pad 50 accordingly dissipates heat from the hot areas on the polishing pad 40, and it supplies heat from the platen 20 to cool areas on the pad 40. Because the heat primarily flows through the thermal conductors 70 in the under-pad 50, the thermal conductors 70 provide thermal conduction paths that enhance the heat transfer between the polishing pad 40 and the platen 20.

One advantage of the under-pad 50 is that it reduces the temperature gradient across the planarizing surface 42 of the polishing pad 40. Since the thermal conductors 70 are made from a material that has a thermal conductivity of at least 0.5 W/m°K, it is estimated that the under-pad 50 has a thermal conductivity of at least approximately 0.4 W/m°K. It is believed that the under-pad 50 of the present invention has a higher thermal conductivity than conventional under-pads. Moreover, when the body 60 is made from polyurethane and the thermal conductors 70 are made from carbon fibers, the under-pad 50 has a thermal conductivity greater than 0.8 W/m°K, a flexural strength of 40–100 ksi, a flexural modulus greater than 5 $MP/m^2$, and a Rockwell hardness greater than 90. Therefore, the under-pad 50 with carbon fiber thermal conductors 70 produces sufficiently planar features and a sufficiently uniform planarization across the face of the wafer because the under-pad 50 provides excellent control of the temperature at the planarizing surface 42 of the polishing pad 40, adequate compressibility to equalize the pressure between the wafer and the polishing pad 40, and sufficient resiliency to resist wear.

Figure 3A:
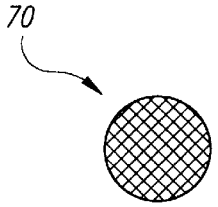
FIG. 3A is a cross-sectional view of a thermal conductor used in an under-pad in accordance with the invention.
Figure 3B:
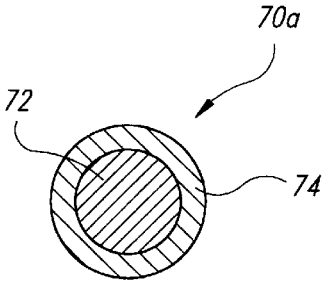
FIG. 3B is a cross-sectional view of another thermal conductor used in an under-pad in accordance with the invention.

FIGS. 3A and 3B illustrate different embodiments of thermal conductors. FIG. 3A illustrates the cross section of the thermal conductor 70 discussed above with respect to FIG. 2. The thermal conductor 70 is preferably a solid strand made from a thermally conductive material that is sufficiently hard to resist wear. FIG. 3B illustrates an alternative thermal conductor 70(*a*) that has a core 72 and a casing 74 positioned around the core 72. The core 72 is preferably a reinforcement element made from a hard material, and the casing 74 is preferably a thermally conductive element made from a thermally conductive material. In a preferred embodiment, the core 72 is made from glass and the casing 74 is made from aluminum. The core 72 of the reinforcement element 70(*a*) provides the necessary hardness to ensure that the under-pad has sufficient wear resistant properties; the casing 74 provides the desired thermal conductance to ensure that the under-pad has sufficient heat transfer properties. The materials of the casing 74 and core 72 may be inverted with one another so that the core 72 is the thermally conductive element and the casing 74 is the reinforcement element. Importantly, since the reinforcement element provides the hardness, the thermally conductive element may be made from a metal that does not react with the chemicals in the slurry.

Figure 4:
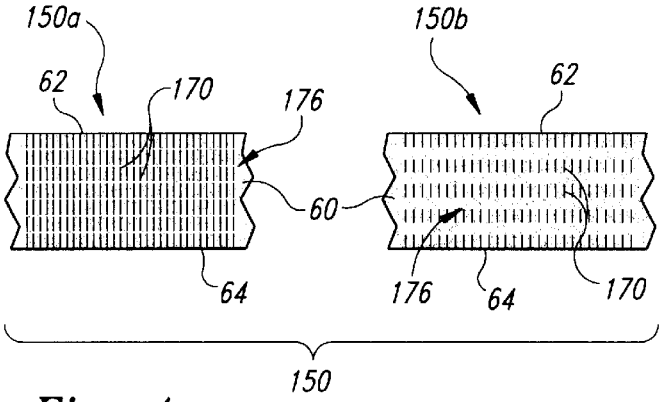
FIG. 4 is a partial schematic cross-sectional view of another under-pad in accordance with the invention.

FIG. 4 illustrates another under-pad 150 in accordance with the invention that has a body 60 with an upper face 62 and a lower face 64. A number of thermal conductors 170, which are small, elongated filaments of a thermally conductive material, are positioned in the body 60. Thus, unlike the under-pad 150 discussed in FIGS. 2 and 3, the thermal conductors 170 do not individually extend from the top face 62 to the bottom face 64 of the body 60. The thermal conductors 170 are preferably oriented with respect to one another to form a plurality of chain-like columns 176 extending from approximately the top face 62 to approximately the bottom face 64. The chain-like columns 176 of thermal conductors 170 operate substantially in the same manner as the strand-like thermal conductors 70 discussed above with respect to the under-pad 50 (shown in FIG. 2).

In another embodiment, the density of thermal conductors 170 and chain-like columns 176 varies from one portion of the under-pad 150 to another. For example, one portion 150(*b*) of the under-pad 150 may have a low density of thermal conductors 170, while another portion 150(*a*) of the under-pad 150 may have a high density of thermal conductors 170. By varying the density of the thermal conductors 170 at different areas on the under-pad 150, the under-pad 150 selectively controls the heat transfer between the polishing pad and the platen (not shown) at selected areas of the polishing pad. In one embodiment, the density of the thermal conductors 170 may vary along the radius of the under-pad 150. This embodiment is particularly useful for large, high velocity polishing pads because the perimeter of the polishing pad generally has a significantly higher temperature than the center of the polishing pad. Accordingly, to better dissipate the heat at selected areas on the polishing pad, the density of the thermal conductors 170 may vary at selected areas in the under-pad 150.

Figure 5:
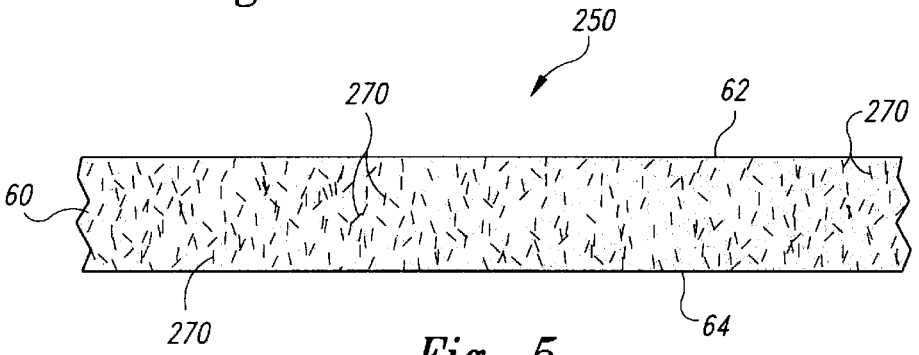
FIG. 5 is a partial schematic cross-sectional view of another under-pad in accordance with the invention.

FIG. 5 illustrates another under-pad 250 in accordance with the invention that has a body 60 with an upper face 62 and a lower face 64. A number of thermal conductors 270, which are elongated filaments, particles, or any other shape that fits within the body 60 of the under-pad 250, are dispersed randomly throughout the matrix material of the body 60. The random orientation of the thermal conductors 270 in the under-pad 250 is particularly useful to enhance the compressibility of the under-pad because the thermal conductors 270 do not act as pillars between the top and bottom faces 62 and 64 of the body 60.

Figure 6:
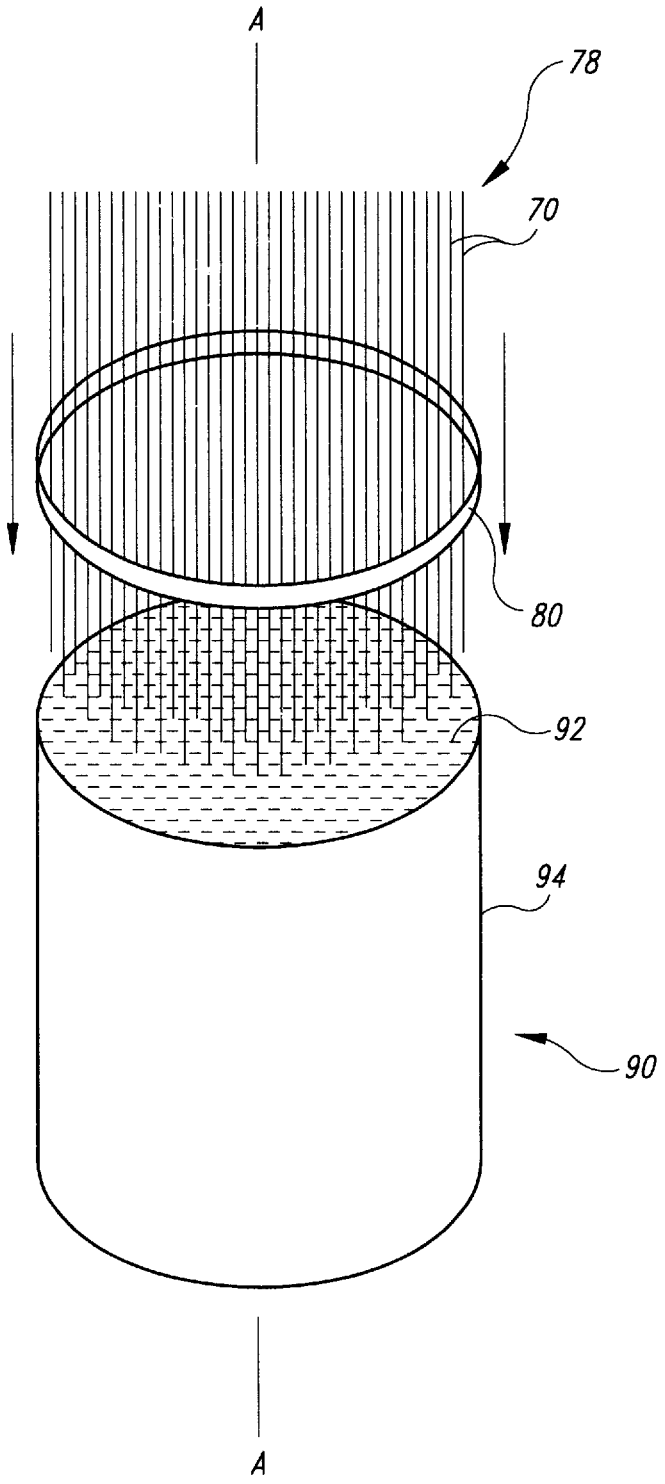
FIG. 6 is a schematic perspective view of a process of making an under-pad in accordance with the invention.

FIG. 6 schematically illustrates the process for making a cake 90 of under-pad material. The thermal conductors 70 are positioned to extend substantially parallel to the longitudinal axis A—A of the cake 90, and then a cincture 80 is wrapped around the thermal conductors 70 to form a bundle 78 of thermal conductors 70. The bundle 78 of thermal conductors 70 is placed into a mold 94 with a liquid matrix material 92 that forms the body 60 of the under-pad. The cincture 80 is subsequently removed from the bundle 78, and the matrix material 92 is cured. The cake 90 of under-pad material is then cut into a number of individual under-pads (not shown).

It will be appreciated that, although specific embodiments of the invention have been described herein for purposes of illustration, various modifications may be made without departing from the spirit and scope of the invention. Accordingly, the invention is not limited except as by the appended claims.

We claim:

1. An under-pad for placement between a polishing pad and a thermally conductive platen of a planarizing machine used in chemical-mechanical planarization of semiconductor wafers, comprising:

a body having a top face upon which the polishing pad is positionable and a bottom face engageable with the platen, the body being made from a compressible continuous phase matrix material; and thermally conductive material in the body, wherein heat from the polishing pad and platen flows through the thermally conductive material to enhance the uniformity of the temperature across the polishing pad.

2. The under-pad of claim 1 wherein the thermally conductive material comprises thermal conductors which are strands that extend from approximately the top face to approximately the bottom face to form a plurality of thermal conduction paths between the top face and the bottom face, whereby heat flows through the thermal conduction paths between the polishing pad and the thermally conductive platen.

3. The under-pad of claim 2 wherein the strands extend substantially normal to the top face and substantially normal to the bottom face to provide substantially direct thermal conduction paths between the top face and the bottom face.

4. The under-pad of claim 1 wherein the thermally conductive material comprises carbon fibers.

5. The under-pad of claim 2 wherein the thermal conductors comprise carbon fibers.

6. The under-pad of claim 1 wherein the thermally conductive material comprises thermal conductors which are a plurality of elongated filaments oriented with respect to one another to form chain-like columns extending from approximately the top face to approximately the bottom face, the chain-like columns creating a plurality of thermal conduction paths between the top face and the bottom face.

7. The under-pad of claim 6 wherein the columns extend substantially normal to the top face and the bottom face.

8. The under-pad of claim 1 wherein the thermally conductive material comprises thermal conductors that are positioned substantially randomly in the body.

9. The under-pad of claim 1 wherein the thermally conductive material further comprise a reinforcement element and a thermally conductive element.

10. The under-pad of claim 9 wherein the reinforcement element comprises a glass core and the thermally conductive element is a metal casing around the core.

11. The under-pad of claim 10 wherein the casing is made from aluminum.

12. The under-pad of claim 2 wherein the strands are bundled together.

13. The under-pad of claim 2 wherein a relative density of thermal conductors to matrix material is approximately 5 to 70% by volume.

14. A planarizing machine for chemical-mechanical planarization of a semiconductor wafer, comprising:

a thermally conductive platen;

an under-pad positioned on the platen, the under-pad having a body and a plurality of thermal conductors positioned in the body, and the body having a bottom face engaging the platen and a top face;

a polishing pad abutting the top face of the under-pad, wherein heat from the polishing pad and platen flows through the thermal conductors to enhance the uniformity of the temperature across the polishing pad; and a wafer carrier positioned over the polishing pad, the wafer being attached to the wafer carrier, wherein at least one of the platen or the wafer carrier is moveable to engage the wafer with the polishing pad and to impart motion between the wafer and polishing pad.

15. The under-pad of claim 14 wherein the thermal conductors comprise strands that extend from approximately the top face to approximately the bottom face to form a plurality of thermal conduction paths between the top face and the bottom face.

16. The under-pad of claim 15 wherein the strands extend substantially normal to the top face and substantially normal to the bottom face to provide substantially direct thermal conduction paths between the top face and the bottom face.

17. The under-pad of claim 14 wherein the thermal conductors comprise carbon fibers.

18. The under-pad of claim 15 wherein the thermal conductors comprise carbon fibers.

19. The under-pad of claim 14 wherein thermal conductors comprise a plurality of elongated filaments oriented with respect to one another to form chain-like columns extending from approximately the top face to approximately the bottom face, the chain-like columns creating a plurality of thermal conduction paths between the top face and the bottom face.

20. The under-pad of claim 19 wherein the columns extend substantially normal to the top face and the bottom face.

21. The under-pad of claims 14 wherein the thermal conductors are positioned substantially randomly in the body.

22. The under-pad of claim 14 wherein the thermal conductors further comprise a reinforcement element and a thermally conductive element.

23. The under-pad of claim 22 wherein the reinforcement element comprises a glass core and the thermally conductive element is a metal casing around the core.

24. The under-pad of claim 23 wherein the casing is made from aluminum.

25. The under-pad of claim 15 wherein the strands are bundled together.

26. The under-pad of claim 15 wherein a relative density of thermal conductors to matrix material is approximately 5 to 70% by volume.

27. The under-pad of claim 1 wherein the matrix material of the body has a first thermal conductivity, and wherein the thermally conductive material in the body comprises a plurality of discrete thermal conductors distributed in the body, the thermal conductors having a second thermal conductivity greater than the first thermal conductivity of the matrix material.

* * * * *